US005507944A

United States Patent [19]

Friedland et al.

[11] Patent Number: 5,507,944

[45] Date of Patent: Apr. 16, 1996

[54] STORM WATER DRAINAGE FILTER SYSTEM

[75] Inventors: Joel Friedland, Bal Harbor; Maria Suzara, Ft. Lauderdale; Randall Foland, Pembroke Pines, all of Fla.

[73] Assignee: Sorbant Corporation, Ft. Lauderdale, Fla.

[21] Appl. No.: 279,976

[22] Filed: Jul. 25, 1994

[51] Int. Cl.[6] ..... E03F 1/00; B01D 29/56

[52] U.S. Cl. ..... 210/155; 210/162; 210/232; 210/249; 210/282; 210/284

[58] Field of Search ..... 210/232, 154, 210/170, 282, 284, 162, 249, 336, 155

[56] References Cited

U.S. PATENT DOCUMENTS

| | | | |
|---|---|---|---|
| 3,657,125 | 4/1972 | Strickman | 210/40 |
| 4,031,839 | 6/1977 | Pedrone | 114/270 |
| 4,230,566 | 10/1980 | Faudree, III | 210/693 |
| 4,366,067 | 12/1982 | Golding et al. | 210/671 |
| 4,906,381 | 3/1990 | Barbaro | 210/335 |
| 5,037,541 | 8/1991 | Ruey-Jang et al. | 210/155 |
| 5,039,406 | 8/1991 | Whittington | 210/249 |
| 5,223,154 | 6/1993 | MacPherson, Jr. et al. | 210/336 |
| 5,232,587 | 8/1993 | Hegemier et al. | 210/170 |
| 5,292,432 | 3/1994 | Jainek et al. | 210/232 |

*Primary Examiner*—Peter A. Hruskoci
*Assistant Examiner*—Theodore M. Green
*Attorney, Agent, or Firm*—Longacre & White

[57] ABSTRACT

The present disclosure concerns a storm runoff filtration system for placement into in-place storm drainage systems. In locations where runoff is directed vertically or nearly vertically downward on gravity flow, an inlet fluid guide of the system directs fluid to a flow through a filter cartridge. The filter cartridge is removable and rechargeable with a selected filter media.

7 Claims, 2 Drawing Sheets

FIG. 1
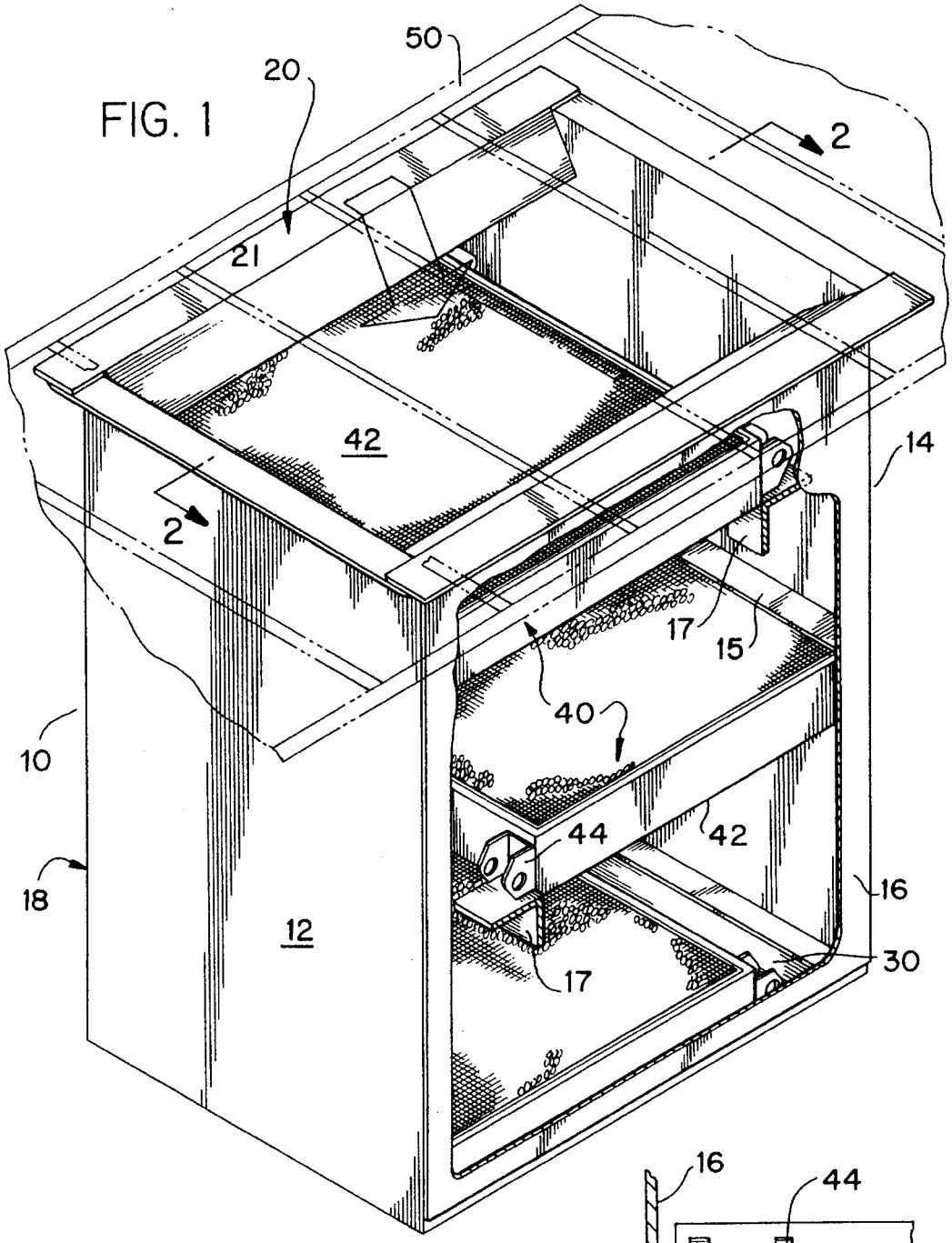
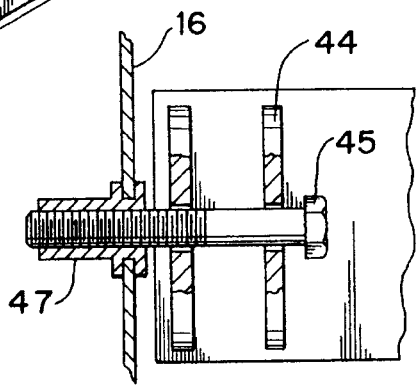
FIG. 4

STORM WATER DRAINAGE FILTER SYSTEM

BACKGROUND OF THE INVENTION a) Field of the Invention

The invention concerns a device useful for filtering fluid runoff from parking lots, industrial sites, and other potential surface runoff pollution sites. The device is particularly directed to a storm water drop inlet liner which includes replaceable filter cartridges. The filter cartridges are packed with a removable and incinerable filter media. The filter cartridges can be repacked with filter media and cycled through the drop inlet liner multiple times.

b) Description of Related Art

This field of invention is comparatively recently developed as it relates to the filtration of storm water runoff from land based surfaces in the public domain. Heretofor surface runoff from potentially toxic sites, i.e., surface mining, jet refueling, or other heavy industrial process, has been captured and filtered or in some respect cleaned prior to departing from the site. Additionally, with the recognition that heavily silt or debris laden runoff also caused downstream contamination of waterways, i.e., local dams and other municipal water control sites, filtering for debris and silt has been commonplace at construction sites.

Often times the filtering systems for toxic wastes have involved the retention of the surface water in a containment system, i.e., a walled fluid tight liner, surrounding the site. Such systems are common at fuel transfer locations (tank farms). The captured runoff is usually treated in a separator, perhaps a multicompartment baffle system which separates the water from the oil or lighter than water constituents. In other systems, the water is treated with additives to reduce or enhance the ph of the accumulated fluid or to neutralize a toxic element found in the fluid. Other systems may use flow through filtration to capture silt, debris, or other targeted toxins in the runoff.

More recently municipalities have begun identifying a much broader range of commercial facilities which are to be runoff restricted. These restrictions extend to the consumer and home level as well. Storm runoff cannot include motor oils, oil based cleaners, antifreeze/antiboil fluids, detergents, and many other potentially harmful toxins. It is well understood that any runoff is directed in its contaminated condition directly to streams, rivers, lakes, and other bodies of water from which fish, water, and other consumable items are harvested. The cumulative effect of contaminated runoff has contributed in large measure to the deterioration of the quality of the harvests in these common bodies of water.

Examples of the newly targeted commercial facilities which are runoff restricted include auto dealer and auto service oriented businesses. Automobiles use a variety of oil based fluids which are toxic as runoff. As a result, auto service related businesses are being required to contain runoff and to control the level of contamination in the runoff.

SUMMARY OF THE INVENTION

An objective of the present invention is to provide a cost effective storm water filter system for fluid runoff. The system combines with the drop inlets of in-place storm water systems and uses recyclable flow through filter media cartridges to capture toxins in the runoff fluid. The system of this invention includes a liner oriented to accommodate the downward flow of water through a series of one or more suspended filter cartridges. The cartridges are sufficiently well related to the liner to avoid displacement by in service vibration, but are also easily removed for access, servicing, and replacement.

The advantages of the system relate to its adaptation for use with in-place storm water drainage systems. Separate liners or containment systems are unnecessary. The liner and cartridge filters are easily sized for a particular inlet type having vertical fluid flow. The filter media used in the preferred embodiment is incinerable.

BRIEF DESCRIPTION OF THE DRAWING

FIG. 1 shows an embodiment of the present invention adapted for a vertically oriented grate covered drop inlet.

FIG. 4 shows an example of a pin and shelf support structure for the replaceable filter cartridge of the present invention as shown in FIG. 1.

DESCRIPTION OF THE PREFERRED EMBODIMENT

Figure 3:
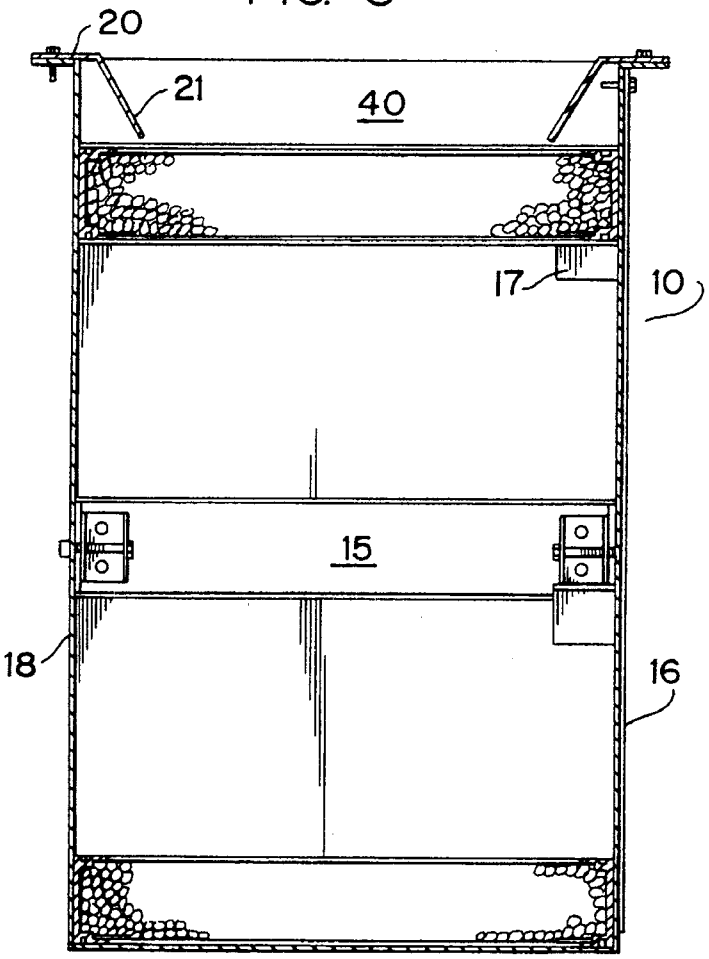
FIG. 3 shows the filter system of the present invention as shown in FIG. 1 in section along 3—3.
Figure 2:
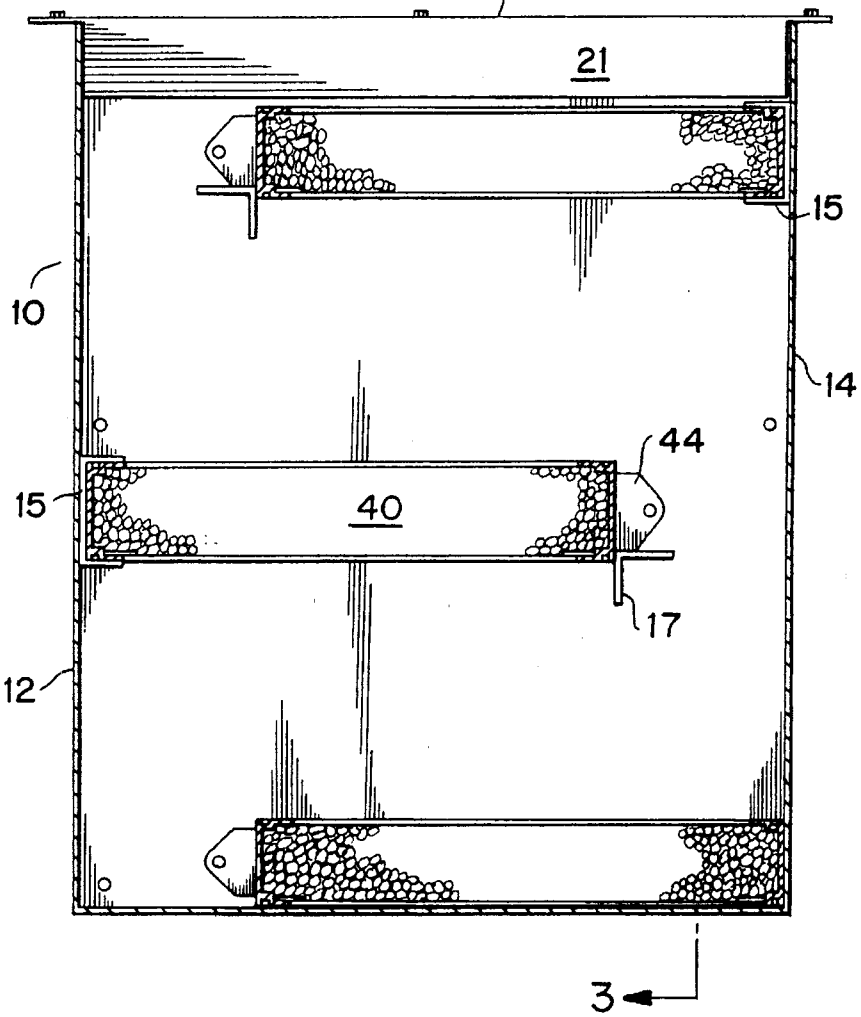
FIG. 2 shows the filter system of the present invention as shown in FIG. 1 in section along 2—2.

A filter system according to the present invention shall now be described with reference to the drawing figures which form a part of this specification. This description is not intended to be limiting in any respect, but is to set forth the best mode of the invention presently contemplated. Modifications to the invention can be made without departing from the scope and spirit of the invention.

A filter system according to the present invention 10 includes a box style surrounding housing. The housing includes front 12 and back 14 walls and side walls 16, 18, which collectively form a conduit extending from the top inlet of the system to the bottom outlet. The top of the housing is surrounded by an fluid inlet guide 20. The inlet guide 20 includes a sloped guide element 21 which directs fluid towards the center of the filter cartridges 40 positioned below the inlet fluid guide 20. Once the fluid has passed through one or more of the filter cartridges, the fluid departs the system through the open bottom outlet of the housing 30. The sloped guide element 21 prevents incoming fluid from wicking along the walls of the filter housing and diverting from the filter cartridges.

The inlet fluid guide in this preferred embodiment is topped by a grate element 50 (shown in dotted outline) which forms a part of the in-place storm water system into which the present filter system is to be inserted. The system according to the present invention can be adapted for any style of storm water fluid inlet which has vertical or substantially inclined gravity driven fluid flow. The housing may be a shape other than box shaped and is preferably adapted to fit within a storm water system without modification to the drop inlet, catch basin, or other drainage structure. The design requirement is that the filter cartridges 40 be easily accessed through the in-place storm water fixture system.

Referring to the embodiment of the invention shown in the drawings, the filter cartridges are made up of a surrounding frame element with filter media retaining screens 42 located along the fluid path sides of the filter cartridge. In this embodiment the filter media is chosen to be a particulate form of polyisocyanurate synthetic foam or equivalent. This type of oil leaching, filtering, and/or adsorbing material or suitable equivalent is disclosed in U.S. Pat. Nos. 4,366,067, 4,230,566, 3,657,125, and 4,031,839, the disclosure of each of which is incorporated herein by reference thereto. The filter media is trapped between the porous screens 42 (metal, plastic, or suitable equivalent) of the filter cartridge 40. The filter media selected is preferably adapted for incineration or other non-toxic deposal.

The cartridge 40 is configured to be easily disassembled to enable removal and replacement of the filter media. The screen sections 42 may be hinged, screwed to, or otherwise removably associated to the perimeter frame of cartridge 40. The design requirement being that the cartridges can be recharged with clean filter media and be reused.

In an alternative embodiment, the entire cartridge can be comprised of a incinerable material and charged with filter media for a single use. The surrounding frame of the cartridge may be a wood or other cellulosic product and the screen elements may be formed from broad weave cloth (i.e., burlap).

The cartridges 40 are replaceably related to the inner portion of the filter system 10. In this embodiment the cartridge 40 is inserted into a front 12 or back 14 wall mounted support shelf 15. The shelf 15 captures an end of the cartridge 40 and prevents the cartridge from falling through the housing of the filter system. An end of the cartridge opposite the shelf 15 is equipped with a support bracket 44 which can be adapted for cooperation with a pin 45 connected to the side wall of the 16, 18 housing such as by threaded bushing 47. Alternatively or in addition, the side wall can include a shelf 17 to support the filter cartridge 40. The shelf 17 may be inverted from the position shown so as to capture the end of the cartridge 40 and prevent its edgewise withdrawal from shelf 15. The filter system of the type described herein will be subject in service to considerable subsurface vibration and movement as vehicles move in proximity to the filter. As such, it is important that while the filter cartridges are easily removable at the same time they must remain securely in position while in service. The mounting system shown herein is intended to maintain the filter cartridges in position.

In the embodiment shown the filter cartridges are aligned in offset relation to the vertical axis of the filter housing. This offset position exists for at least two reasons. The first reason is access. The filter cartridge 40 must be easily accessed and to accommodate this need a space is provided alongside the perimeter frame of the cartridge 40 within the housing to enable service and replacement of the cartridge through the inner space of the housing. The second reason is to keep the filter in service even when a given filter cartridge can no longer pass fluid and to accommodate flood stage water passage as necessary. If a filter cartridge becomes blocked by debris or is no longer capable of filtering, fluid may bypass the blocked filter, and pass through an offset filter below. On the other hand if flood stage waters enter the filter system, the offset position of the filter cartridges allows a bypass to be accomplished until the flood stage decreases.

What is claimed is:

1. A storm runoff filter system for placement in a substantially downwardly directed flow of fluid in a storm runoff structure, comprising:

a housing having an upper fluid inlet and a bottom fluid outlet, said inlet and outlet being connected by sidewall portions which form a conduit between said inlet and said outlet;

at least one filter cartridge having a surrounding frame member and upper and lower spaced apart filter media retaining means for containing a selected filter media therebetween, said filter cartridge is removably mounted within said conduit and oriented to intercept fluid passing from said inlet to said outlet such that fluid passes through said upper and lower filter media retaining means and through said filter media; and, an inlet fluid guide mounted within said conduit for directing fluid to said filter cartridge and away from inner surfaces of said conduit, said inlet fluid guide comprising a shaped guide element entirely lining said inner surfaces of said conduit and interposed between said upper fluid inlet and said at least one filter cartridge, said sloped inlet fluid guide having an inlet substantially matching in size said conduit and an outlet sized smaller than said conduit thereby directing said flow of fluid entirely towards said filter cartridge filter media.

2. A storm runoff filter system as recited in claim 1, further comprising:

multiple filter cartridges positioned along a length of said conduit to successively intercept fluid passing through said housing from said inlet to said outlet.

3. A storm runoff filter system as recited in claim 2, wherein:

said multiple filter cartridges are offset one to the next along an axis passing through said housing from said inlet to said outlet.

4. A storm runoff filter system as recited in claim 1, said mounting of said filter cartridge further comprising:

a first shelf positioned along an inner portion of said conduit for engaging a first edge portion of said cartridge frame and a second cooperating shelf positioned oppositely within said conduit for supporting a second opposing edge portion of said cartridge frame and preventing said cartridge from edgewise withdrawal from said first shelf.

5. A storm runoff filter system as recited in claim 1, said mounting of said filter cartridge further comprising:

a first shelf positioned along an inner portion of said conduit for engaging a first edge portion of said cartridge frame, an opposite second edge portion of said cartridge frame comprising a bracket including a pin mounting means thereon, an inner surface of said conduit including a pin mount connecting means thereon for receiving a pin connecting means and supporting said second edge portion of said filter cartridge through said pin connecting means to said bracket.

6. A storm runoff filter system as recited in claim 1, said selected filter media is particulate polyisocyanurate synthetic foam.

7. A storm runoff filter system for placement in a flow of fluid, said filter system comprising:

a conduit circumscribing the flow of fluid;

a fluid inlet through which the flow of fluid enters said conduit;

a fluid outlet through which the flow of fluid exits said conduit;

at least one filter cartridge interposed between said fluid inlet and said fluid outlet, said at least one filter cartridge includes particulate polyisocyanurate synthetic foam through which the flow of fluid passes; and, an inlet fluid guide mounted within said conduit for directing fluid to said filter cartridge and away from inner surfaces of said conduit, said inlet fluid guide comprising a sloped guide element entirely lining said inner surface of said conduit and interposed between said Upper fluid inlet and said at least one filter cartridge, said sloped inlet fluid guide having an inlet substantially matching in size said conduit and an outlet sized smaller than said conduit thereby directing said flow of fluid entirely towards said filter cartridge filter media.

* * * * *